US008701622B2

(12) United States Patent
Sugiyama et al.

(10) Patent No.: US 8,701,622 B2
(45) Date of Patent: Apr. 22, 2014

(54) LUBRICATION SYSTEM FOR PORTABLE FOUR-STROKE ENGINE

(75) Inventors: Masaki Sugiyama, Numazu (JP); Toshihiro Tomita, Numazu (JP); Masaki Kurimoto, Numazu (JP); Hiroshi Kubota, Numazu (JP)

(73) Assignee: Makita Corporation, Anjo-shi (JP)

( * ) Notice: Subject to any disclaimer, the term of this patent is extended or adjusted under 35 U.S.C. 154(b) by 262 days.

(21) Appl. No.: 12/876,722

(22) Filed: Sep. 7, 2010

(65) Prior Publication Data

US 2011/0067659 A1 Mar. 24, 2011

(30) Foreign Application Priority Data

Sep. 24, 2009 (JP) ..... 2009-219044

(51) Int. Cl.
*F01M 9/10* (2006.01)

(52) U.S. Cl.
USPC ..... 123/196 CP; 123/90.33

(58) Field of Classification Search
USPC ..... 123/90.33, 90.34, 90.35, 90.36, 90.38, 123/196 R, 196 CP
See application file for complete search history.

(56) References Cited

U.S. PATENT DOCUMENTS 4,662,322 A * 5/1987 Tamba et al. ..... 123/41.86
5,924,400 A * 7/1999 Kobayashi ..... 123/196 R
6,021,766 A * 2/2000 Maeda et al. ..... 123/573
6,167,874 B1 * 1/2001 Becker et al. ..... 123/572
6,202,613 B1 * 3/2001 Nagai ..... 123/90.34
6,213,079 B1 * 4/2001 Watanabe ..... 123/196 R
6,394,061 B2 * 5/2002 Ryu et al. ..... 123/196 R
6,694,942 B1 * 2/2004 Massmann et al. ..... 123/190.8
6,705,263 B2 * 3/2004 Ito et al. ..... 123/90.31
6,715,461 B2 * 4/2004 Ito et al. ..... 123/196 R
6,786,184 B2 * 9/2004 Oh ..... 123/41.82 R (Continued)

FOREIGN PATENT DOCUMENTS

JP U-62-10262 1/1987
JP A-09-170417 6/1997

(Continued)

OTHER PUBLICATIONS

European Search Report issued in European Application No. EP 10 17 8603.6 dated Jan. 31, 2011.

(Continued)

*Primary Examiner* — Noah Kamen
*Assistant Examiner* — Long T Tran
(74) *Attorney, Agent, or Firm* — Oliff PLC

(57) ABSTRACT

A lubrication system for a portable four-stroke engine includes an opening end of the breather passage is disposed at substantially a center of a valve-operating chamber, and the valve-operating chamber is formed by attaching a valve-operating chamber cover. An inner cover is attached to an inner surface of the valve-operating chamber cover so as to be provided along and in contact with the inner surface of the valve-operating chamber cover. A suction passage is formed as a gap between the circumferential edge of the top plate portion and the inner cover. Three or more suction tubes that are in communication with the suction passage are provided in the inner cover, each of the suction tubes having an opening end. At least one of the opening ends of the suction tubes is provided lower than the opening end of the breather passage in an attitude of the engine during use.

1 Claim, 12 Drawing Sheets

(56) References Cited

U.S. PATENT DOCUMENTS

| | | | | |
|---|---|---|---|---|
| 6,786,187 | B2 * | 9/2004 | Nagai et al. | 123/196 R |
| 7,243,632 | B2 * | 7/2007 | Hu | 123/196 R |
| 7,287,508 | B2 * | 10/2007 | Kurihara | 123/196 R |
| 2001/0045199 | A1 * | 11/2001 | Nagai et al. | 123/196 R |
| 2003/0079704 | A1 | 5/2003 | Ito et al. | |
| 2004/0255895 | A1 * | 12/2004 | Hirsch et al. | 123/196 R |
| 2005/0279318 | A1 * | 12/2005 | Nagel et al. | 123/196 R |
| 2009/0013959 | A1 | 1/2009 | Lin | |
| 2009/0084342 | A1 * | 4/2009 | Henglin | 123/196 CP |
| 2010/0307448 | A1 * | 12/2010 | Chen et al. | 123/196 CP |

FOREIGN PATENT DOCUMENTS

| | | | |
|---|---|---|---|
| JP | A-11-125107 | | 5/1999 |
| JP | 11148333 | A * | 6/1999 |
| JP | A-2002-147213 | | 5/2002 |
| JP | A-2007-263069 | | 10/2007 |
| WO | WO 2009/135400 | A1 | 11/2009 |

OTHER PUBLICATIONS

Apr. 23, 2013 Office Action issued in Japanese Patent Application No. 2009-219044 w/translation.

* cited by examiner

LUBRICATION SYSTEM FOR PORTABLE FOUR-STROKE ENGINE

FIELD OF THE INVENTION

The present invention relates to a lubrication system for a portable four-stroke engine and, in particular, to a lubrication system for a portable four-stroke engine in which no reduction in lubrication performance within the engine occurs even when the attitude of the engine is variously changed during use.

BACKGROUND OF THE INVENTION

Two-stroke engines are conventionally used as the driving engines of portable power tools, such as portable trimmers for trees and plants and backpack power tools, carried by the operators themselves or on the backs of the operators. However, for example, as awareness of environmental issues grows and emission regulations become more stringent, there is an increasing need for replacement of two-stroke engines used as driving sources with four-stroke engines.

However, the numbers of required components of four-stroke engines are greater than those of two-stroke engines, and therefore the weights of the four-stroke engines tend to be greater than those of the two-stroke engines. A portable power tool, in particular, is used on the premise that the operator carries the tool during operation, and therefore there is a demand for a weight reduction of the engine.

Patent Document 1 proposes a lubrication system for a four-stroke engine. In this lubrication system, a pump for lubrication is not separately provided, and pressure changes in a crank chamber are utilized to circulate oil. In this lubrication system, a negative pressure created in the crank chamber is utilized to supply oil mist generated in an oil tank to the crank chamber through a first oil passage that is drilled in a crankshaft and communicates the oil tank with the crank chamber, and the crankshaft and components therearound are thereby lubricated. The floating oil mist generated in the oil tank is delivered, by utilizing a positive pressure created in the crank chamber, to a power transmission mechanism (including an intake valve and an exhaust valve) in a first valve-operating chamber and a cam mechanism in a second valve-operating chamber, which are disposed above the oil tank when the engine is upright, and these driving components are thereby lubricated.

A partition plate is disposed inside a head cover that forms the second valve-operating chamber. The partition plate partitions the space inside the head cover into an upper section serving as a breather chamber and a lower section serving as the second valve-operating chamber. The breather chamber is in communication with the second valve-operating chamber through a communication part that opens into the second valve-operating chamber. A box-shaped partition member is welded to the partition plate, and an oil collection chamber is formed between the partition plate and the partition member. Suction tubes extending toward the power transmission mechanism in the second valve-operating chamber are provided in the partition plate, and suction tubes extending toward the ceiling surface of the head cover are provided in the partition member. A conduit tube that is in communication with the oil collection chamber and protrudes toward the second valve-operating chamber is provided in the partition plate. The conduit tube is in communication with the crank chamber.

In this lubrication system, when a negative pressure is created in the crank chamber as the crankshaft rotates, a negative pressure is also formed in the oil collection chamber through the conduit tube. Therefore, the oil accumulated in the second valve-operating chamber or the breather chamber is sucked through the suction tubes and returned to the crank chamber.

PRIOR ART DOCUMENT

Patent Document

[Patent Document 1] Japanese Patent Application Laid-Open No. 2002-147213 (see paragraphs [0041] to [0051], FIGS. 5 and 10)

The oil collection chamber in the conventional lubrication system is formed by attaching the box-shaped partition member to the partition plate provided in the head cover and has a bent shape that is bent to avoid the power transmission mechanism (including the intake valve and the exhaust valve) provided in the second valve-operating chamber. Therefore, the oil collection chamber has a complicated structure, and there is the problem in which this structure is not a simple structure suitable for production purposes.

SUMMARY OF THE INVENTION

The present invention has been made in view of the above circumstances, and it is an object of the invention to provide a lubrication system for a portable four-stroke engine, the lubrication system including a passage for collecting oil accumulated in a valve-operating chamber. The passage for collecting oil provides sufficient oil collection efficiency and has a simple structure suitable for production purposes.

To solve the foregoing problem, a first aspect of the present invention provides a lubrication system for a portable four-stroke engine. The lubrication system is configured to lubricate components in a valve-operating chamber and in a crank chamber with oil (such as lubricating oil A in an embodiment) by supplying the oil by utilizing changes in pressure inside the crank chamber caused by reciprocating movement of a piston while circulating the oil, the valve-operating chamber accommodating intake and exhaust valve mechanisms therein. In addition, lubrication system is configured to discharge blow-by gas in an oil circulation path from the valve-operating chamber to a combustion chamber through a breather passage connected to the valve-operating chamber. In the lubrication system, an opening end of the breather passage on a side of the valve-operating chamber is disposed at substantially a center of the valve-operating chamber, and the valve-operating chamber is formed by attaching a valve-operating chamber cover. The valve-operating chamber cover has a top plate portion and a side plate portion disposed along a circumferential edge of the top plate portion so as to be formed in a cap shape. An inner cover is attached to an inner surface of the valve-operating chamber cover so as to be provided along and in contact with the inner surface of the valve-operating chamber cover. A suction passage is formed as a gap between the circumferential edge of the top plate portion and the inner cover, the gap being formed by attaching the inner cover to the valve-operating chamber cover. Three or more suction tubes that are in communication with the suction passage are provided in the inner cover, each of the suction tubes extending to the vicinity of an end surface of the valve-operating chamber which faces the top plate portion, each of the suction tubes having an opening end that is disposed in the vicinity of the end surface. A direct passage (such as a passage including a cover-side direct passage 47 and a block-side direct passage 48 in the embodiment) is provided which communicates the suction passage with the crank chamber when a negative pressure is created in the crank chamber. At least one of the opening ends of the three or more suction tubes is provided lower than the opening end of the breather passage in an attitude of the four-stroke engine during use.

The valve-operating chamber cover covers the valve mechanisms and forms a space that can receive blow-by gas and oil mist supplied from the crank chamber. The inner cover has a shape that conforms to the inner surface of the valve-operating chamber cover and is attached to the inner surface of the valve-operating chamber cover so as to be in contact therewith. When the inner cover is attached to the valve-operating chamber cover, the suction passage is formed as the gap between the inner cover and the circumferential edge of the top plate portion of the valve-operating chamber. More specifically, the valve-operating chamber cover includes the top plate portion that forms a top portion and the side plate portion connected to the circumferential edge of the top plate portion to be formed into a cap shape. The valve-operating chamber cover is configured such that, when the inner cover is attached inside the valve-operating chamber cover, the suction passage is formed as the gap between the connection portion of the top plate portion to the side plate portion and a portion of the inner cover that faces the connection portion.

In the present invention, oil is circulated by utilizing changes in pressure inside the crank chamber caused by the reciprocating movement of the piston. The crank chamber serving as a pressure source for oil circulation and the valve-operating chamber are connected through the direct passage. The direct passage communicates the valve-operating chamber with the crank chamber when a negative pressure is created in the crank chamber. Therefore, even when oil mist is liquefied in the valve-operating chamber and a large amount of the liquefied oil stays therein, the oil can be instantaneously delivered to the crank chamber by the strong negative pressure, so that the accumulation of the oil in the valve-operating chamber can be sufficiently suppressed.

In a second aspect, a gap in communication with the suction passage is formed between the valve-operating chamber cover and the inner cover and forms a part of the direct passage (for example, a cover-side direct passage 47 in the embodiment). More specifically, the gap is formed between the side plate portion of the valve-operating chamber cover and the side plate portion of the inner cover. The gap communicates with the suction passage and forms a part of the direct passage.

The three or more suction tubes are disposed such that at least one of the opening ends of the suction tubes can be immersed in the oil accumulated in the valve-operating chamber in an operating attitude of the portable four-stroke engine. More specifically, in a third aspect, two of the three or more suction tubes are disposed in the valve-operating chamber and located at positions near opposite widthwise ends of a first side of the valve-operating chamber near a working unit which receives power from a crankshaft during operation. At least one of the three or more suction tubes is disposed in the valve-operating chamber and located at a position near a second side of the valve-operating chamber, the second side being opposite to the first side near the working unit.

By disposing two suction tubes at positions near the opposite widthwise ends of the first side of the valve-operating chamber near the working unit, the oil accumulated in the valve-operating chamber can be effectively sucked even in a power tool, such as a trimmer, that is operated with its working unit tilted downward during normal operation. By disposing at least one suction tube at a position near the second side of the valve-operating chamber that is opposite to the first side near the working unit, the oil accumulated in the valve-operating chamber can be effectively sucked even in a portable power tool, such as a trimmer, that is generally operated with its working unit tilted downward and also operated with the working unit tilted upward.

In a fourth aspect, small holes in communication with the suction passage are provided at positions near connection portions of the suction tubes provided in the inner cover to the inner cover. The positions near the connection portions of the suction tubes to the inner cover shall mean positions around the connection portions. More specifically, the small holes are formed in the top plate portion of the inner cover. Therefore, even when the four-stroke engine is used upside down, the oil accumulated in the valve-operating chamber is sucked through the small holes. In this manner, the oil accumulated in the valve-operating chamber can be effectively sucked even when the portable power tool is used in any attitude. Since the small holes are disposed near the connection portions of the suction tubes to the inner cover, the communication structure with the suction passage is suitable for production purposes.

In the lubrication system for a portable four-stroke engine according to the present invention, three or more suction tubes are provided which are in communication with the suction passage, extend to the vicinity of the end surface of the valve-operating chamber that faces the top plate portion, and have opening ends disposed in the vicinity of this end surface. In addition, the direct passage is provided which communicates the suction passage with the crank chamber when a negative pressure is created in the crank chamber. Therefore, oil can be sufficiently collected from the valve-operating chamber. Moreover, the accumulation of the oil in the valve-operating chamber can be suppressed. The inner cover is configured such that, when the inner cover is attached to the valve-operating chamber cover formed into a cap shape, the suction passage is formed as the gap between the inner cover and the circumferential edge of the top plate portion of the valve-operating chamber cover, and a plurality of suction tubes are provided in the inner cover. Therefore, when the inner cover and the valve-operating chamber cover which have simple structures suitable for production purposes are attached to each other, a passage for collecting oil from the valve-operating chamber can be easily formed. The opening end of the breather passage on the side of the valve-operating chamber is disposed at substantially the center of the valve-operating chamber, and at least one of the opening ends of the plurality of suction tubes is located lower than the opening end of the breather passage in the attitude of the four-stroke engine during use. Therefore, even when a certain amount of oil is accumulated in the valve-operating chamber, the oil is prevented from being easily released from the breather passage into the combustion chamber, and the oil consumption can thereby be reduced.

DETAILED DESCRIPTION OF THE PREFERRED EMBODIMENTS

Figure 1:
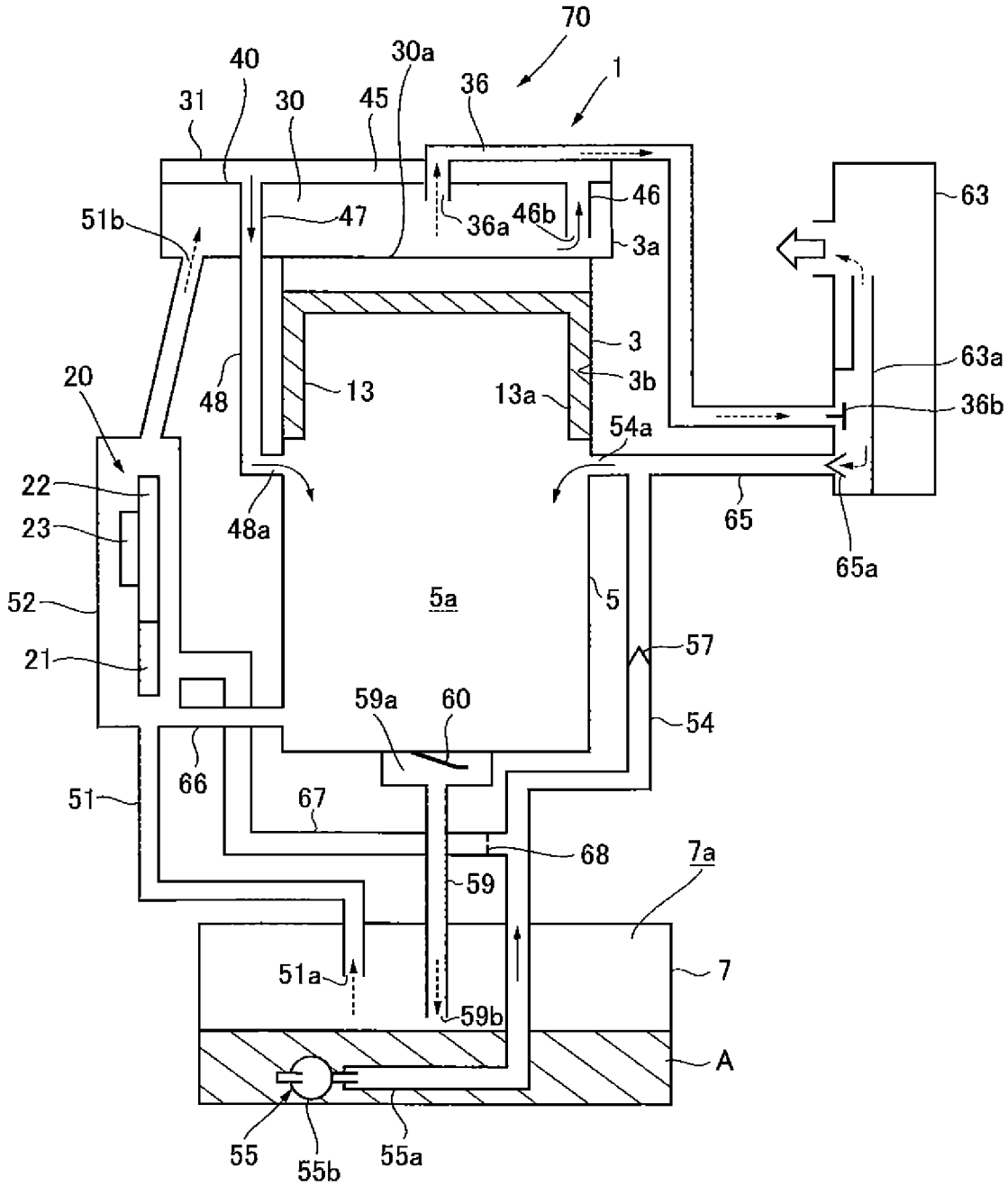
FIG. 1 is a schematic diagram illustrating a lubrication system for a portable four-stroke engine according to one embodiment of the present invention.
Figure 2:
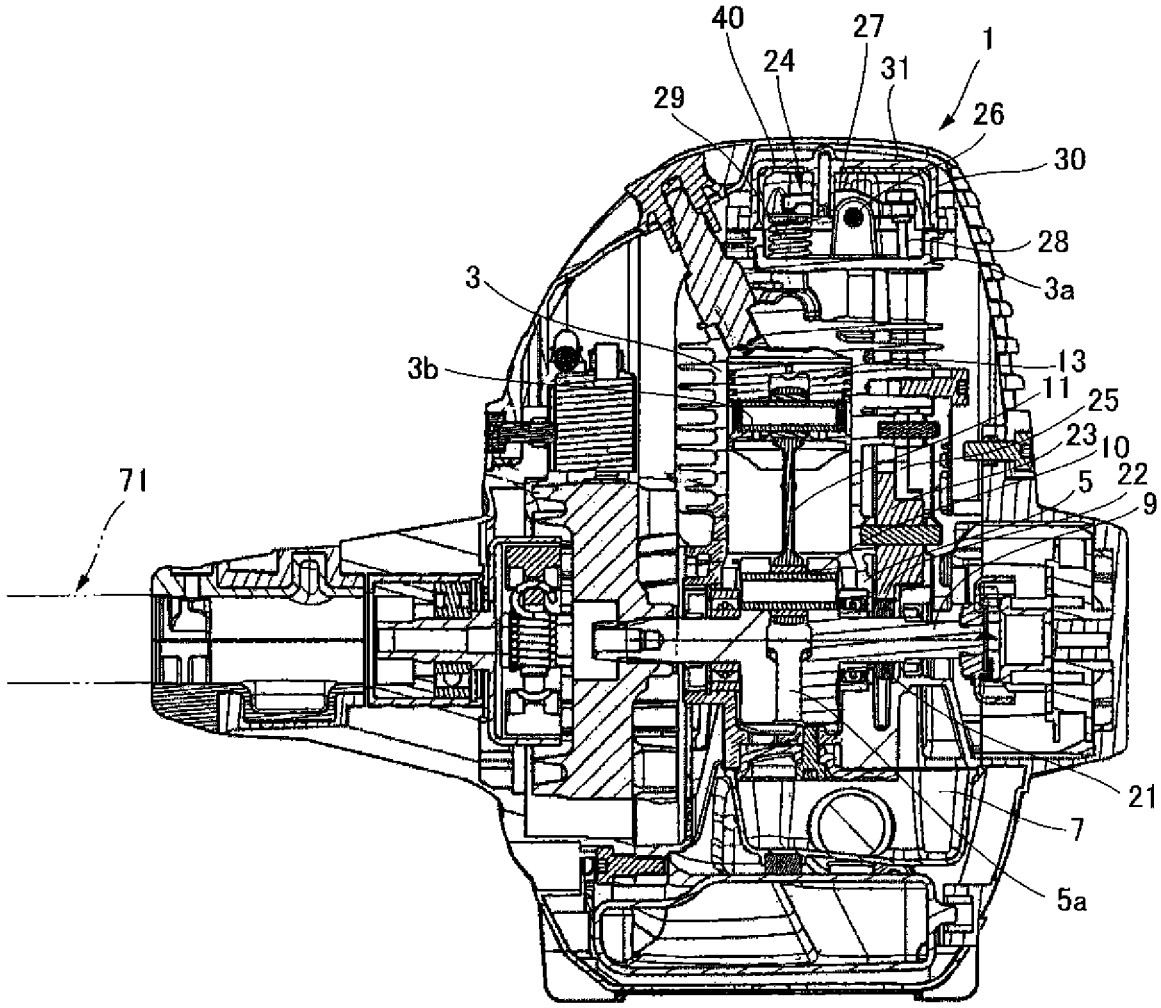
FIG. 2 is a cross-partial view of the portable four-stroke engine equipped with the lubrication system according to the present invention.

Hereinafter, preferred embodiments of a lubrication system for a portable four-stroke engine of the present invention will be described with reference to FIGS. 1 to 10B. The lubrication system is installed in a portable four-stroke engine, and therefore a description will be given of the portable four-stroke engine equipped with the lubrication system with reference to FIG. 1 (schematic diagram) and FIG. 2 (cross-partial view). FIGS. 1 and 2 show the portable four-stroke engine 1 when a piston 13 is at the top dead center.

The portable four-stroke engine 1 (hereinafter referred to simply as "engine 1") includes a cylinder block 3 integrated with a cylinder head 3*a*, a crank case 5 that is attached to the lower portion of the cylinder block 3 and forms a crank chamber 5*a*, and an oil reservoir 7 disposed below the crank case 5, as shown in FIG. 1. The oil reservoir 7 is provided separately from the crank case 5 and stores lubricating oil A (hereinafter referred to simply as "oil A").

As shown in FIG. 2, a crankshaft 9 is rotatably supported by the cylinder block 3 and the crank case 5. The piston 13 connected to a crank pin 10 of the crankshaft 9 through a connecting rod 11 is slidably inserted into a cylinder 3*b* formed in the cylinder block 3.

An intake port and an exhaust port that communicate with a carburetor (not shown) and an exhaust muffler (not shown), respectively, are provided in the upper wall of the cylinder 3*b* formed in the cylinder block 3, and an intake valve and an exhaust valve for opening and closing the intake and exhaust ports are disposed in these ports.

A valve operating unit 20 for driving these valves includes: a valve driving gear 21 that is secured to the crankshaft 9; a cam gear 22 driven by the valve driving gear 21; a cam 23 connected to one end of the cam gear 22; a pair of cam followers 25 that are oscillated by the cam 23 and rotatably supported on the cylinder block 3; a pair of rocker arms 27 that are supported on the rocker shaft 26 disposed on the head portion of the cylinder block 3 and abut against the valve heads of the intake and exhaust valves at first ends; a pair of push rods 28 that connect the cam followers 25 to the second ends of the rocker arms 27; and valve springs 29 that urge the intake and exhaust valves in the directions of closing the valves. The valve driving gear 21, the cam gear 22, and the cam 23 that constitute a part of the valve operating unit 20 are accommodated in a valve driving chamber 52 (see FIG. 1) provided in a supply passage 51 (see FIG. 1) that communicates the oil reservoir 7 with a valve-operating chamber 30 formed on the head portion of the cylinder block 3.

An oil feed passage 54 is disposed between the oil reservoir 7 and the cylinder block 3, as shown in FIG. 1. A suction part 55 is attached to the end of the oil feed passage 54 on the oil reservoir side. The suction part 55 includes: a tubular portion 55*a* that is formed of an elastic material such as rubber and is easily bendable; and a weight 55*b* having an intake port and attached to the end of the tubular portion 55*a*. The weight 55*b* of the suction part 55 is attached so as to be movable downward in a vertical direction by gravity. Therefore, even when the oil reservoir 7 is tilted, the intake port of the suction part 55 can stay below the surface of the oil A that is stored in the oil reservoir 7 in an amount within a rated range.

When a negative pressure tends to be created in the crank chamber 5*a* as the piston 13 moves upward, the oil feed passage 54 allows the crank chamber 5*a* and the oil reservoir 7 to be in communication with each other so that the oil A is thereby sucked from the oil reservoir 7 and supplied to the crank chamber 5*a* through the oil feed passage 54. An opening end 54*a* of the oil feed passage 54 being opened in the crank chamber 5*a* is disposed so as to establish communication with the crank chamber 5*a* when the piston 13 moves from a position near a top dead center toward the top dead center. This opening end 54*a* is positioned on the bottom dead center side of a skirt 13*a* provided in the lower portion of the piston when the piston is moved to the position near the top dead center. Therefore, the opening end 54*a* of the oil feed passage 54 is already in a fully open state when the piston 13 reaches the top dead center.

The oil feed passage 54 may be allowed to be in communication with the crank chamber 5*a*, when a negative pressure is created in the crank chamber 5*a*, by providing a reed valve at the opening end 54*a* of the oil feed passage 54, or providing a passage in the crankshaft 9 so as to function as a rotary valve.

A one-way valve 57 is provided in the oil feed passage 54. The one-way valve 57 is configured so as to be opened and closed according to the change in pressure inside the crank chamber 5*a*. More specifically, the one-way valve 57 is opened to communicate the oil feed passage 54 with the crank chamber 5*a* when the pressure inside the crank chamber 5*a* is lower than the pressure inside the oil reservoir 7. The one-way valve 57 is closed when the pressure inside the crank chamber 5*a* is higher than the pressure inside the oil reservoir 7.

A communication passage 59 for communicating the crank chamber 5*a* with the oil reservoir 7 is provided between the bottom portion of the crank chamber 5*a* and the oil reservoir 7. The communication passage 59 is used to deliver oil mist generated in the crank chamber 5*a* and liquid oil formed by liquefaction of the oil mist to the oil reservoir 7. A reed valve 60 is provided at the opening end 59*a* of the communication passage 59 being opened to the crank chamber. The reed valve 60 is configured so as to be opened and closed according to the change in pressure inside the crank chamber 5*a*. More specifically, the reed valve 60 is opened by a positive pressure created inside the crank chamber when the piston 13 moves toward the bottom dead center, so that the communication passage 59 is allowed to communicate with the crank chamber. Therefore, when the reed valve 60 is opened to allow the communication passage 59 to be in communication with the crank chamber, the oil mist and oil in the crank chamber 5*a* is delivered to the oil reservoir 7 through the communication passage 59.

The communication passage 59 has an opening end 59*b* being opened to the oil reservoir 7 and disposed at substantially the center of the oil reservoir 7. Irrespective of the tilted state of the oil reservoir 7, the opening end 59*b* is located at a position above the surface of the oil A that is stored in the oil reservoir 7 in an amount equal to or less than the rated amount. Therefore, the oil mist ejected from the opening end 59*b* of the communication passage 59 is blown against the oil surface, and the oil is not bubbled. Accordingly, the oil mist is gently returned to the oil reservoir 7, and most of the oil mist is liquefied. However, part of the oil mist ejected from the opening end 59*b* bounces off the oil surface and the wall surfaces of the oil reservoir 7 and stays in a space 7*a* above the oil surface in the oil reservoir 7. As described above, the opening end 59*b* of the communication passage 59 that is disposed above the surface of the oil A functions as a part of liquefying means for liquefying oil mist.

Therefore, most of the oil mist ejected from the communication passage 59 is liquefied, so that the concentration of oil mist staying in the oil reservoir 7 can be reduced.

An opening end 51*a* of the supply passage 51 is opened to the oil reservoir 7 and disposed at substantially the center of the inner space of the oil reservoir 7. Irrespective of the tilted state of the oil reservoir 7, the position of the opening end 51*a* is always above the surface of the oil stored in the oil reservoir 7 in an amount equal to or less than the rated amount, even when the position of the oil surface is changed. Moreover, the opening end 51*a* is disposed such that the opening end 59*b* protrudes further than the opening end 51*a*.

As described above, the opening end 59*b* of the communication passage 59 and the opening end 51*a* of the supply passage 51 are disposed in the oil reservoir 7 such that the opening end 59*b* protrudes further than the opening end 51*a*. Therefore, the oil mist ejected from the opening end 59*b* of the communication passage 59 does not directly enter the opening end 51*a* of the supply passage 51. More specifically, the arrangement of the supply passage 51 and the communication passage 59 in the oil reservoir 7 functions as a flow blocking mechanism for preventing the oil mist ejected from the communication passage 59 from flowing directly into the opening end 51*a* of the supply passage 51. Therefore, the concentration of the oil mist flowing through the supply passage 51 is lower than the concentration of the oil supplied from the oil feed passage 54 to the crank chamber 5*a*.

An opening end 51*b* of the supply passage 51 is opened to the valve-operating chamber 30 so as to be in communication with the valve-operating chamber 30 on its cylinder block 3 side. Therefore, the oil mist flowing through the supply passage 51 lubricates a valve-operating mechanism 19 (including a valve driving gear 24 and the cam gear 22) in the valve driving chamber 52. The oil mist is then ejected from the opening end 51*b* and supplied to the valve-operating chamber 30, so as to lubricate the rocker arms and other components in the valve-operating chamber 30.

Figure 3B:
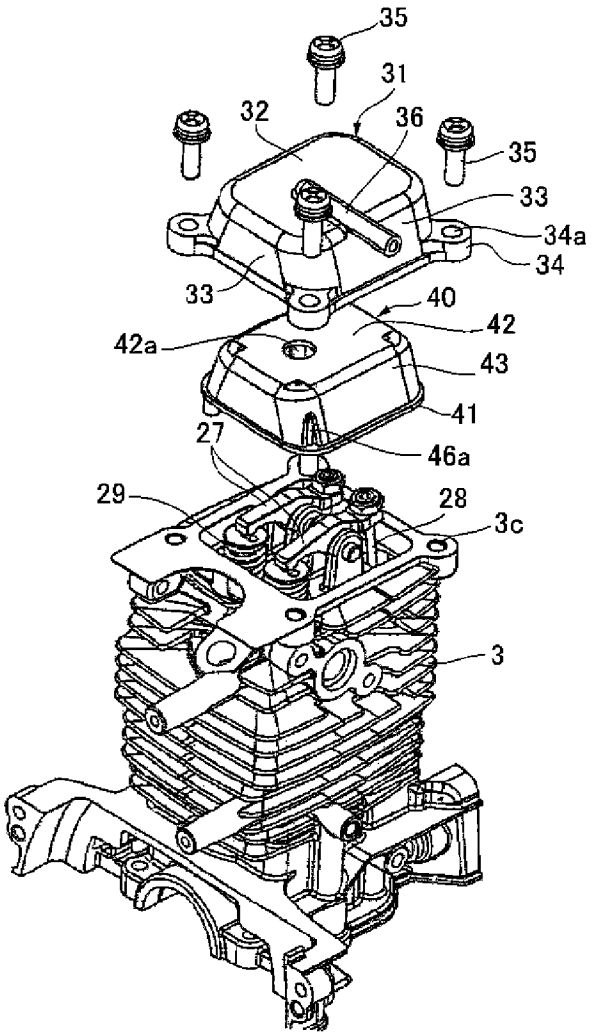
FIG. 3B is a partially exploded perspective view of the portable four-stroke engine equipped with the lubrication system according to the present invention.
Figure 3A:
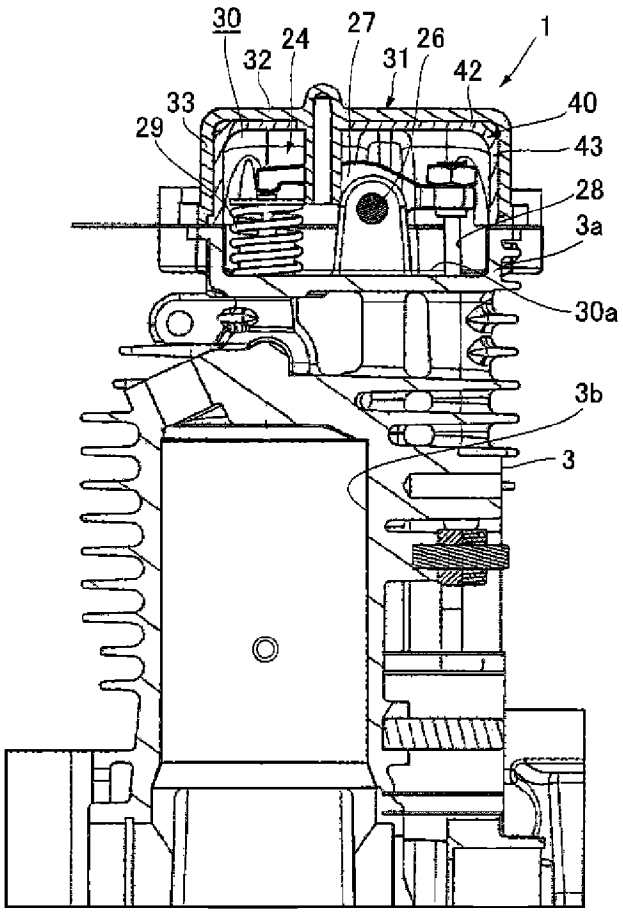
FIG. 3A is a cross-partial view of a part of the portable four-stroke engine equipped with the lubrication system according to the present invention.

As shown in FIGS. 3A and 3B, the valve-operating chamber 30 includes: a valve-operating chamber cover 31 that covers the rocker arms 27, the push rods 28, and the valve springs 29 (hereinafter collectively referred to as a "valve mechanism 24") that are components of the valve operating unit 20 used to drive the intake and exhaust valves provided on the end surface of the valve-operating chamber 30 on the crank chamber side; and an inner cover 40 that is attached along the inner surface of the valve-operating chamber cover 31.

Figure 4A:
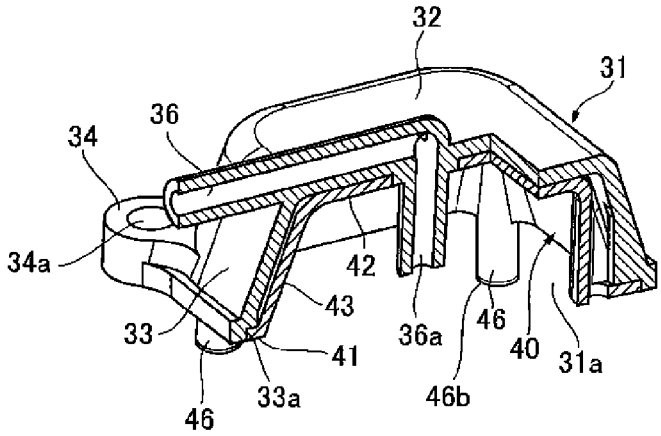
FIGS. 4A, 4B, and 4C are cross-partial views illustrating a valve-operating chamber cover and an inner cover that constitute the valve-operating chamber of the portable four-stroke engine.
Figure 4B:
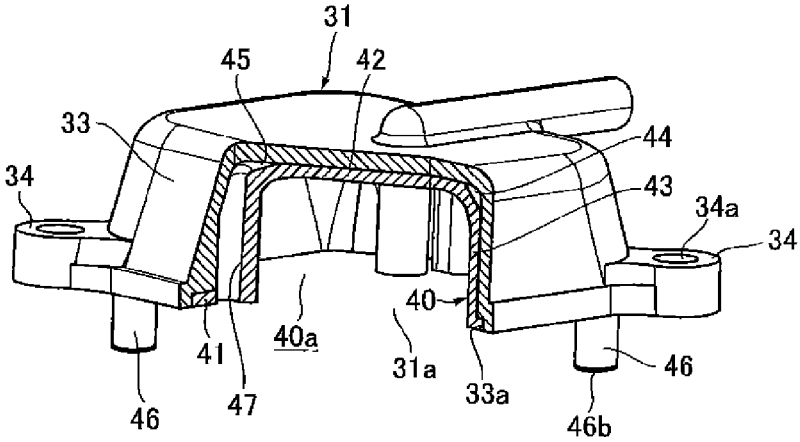
Figure 4C:
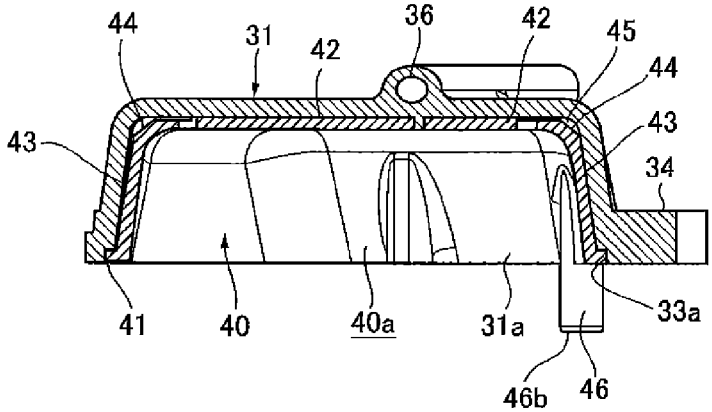

The valve-operating chamber cover 31 includes a rectangular top plate portion 32 and a side plate portion 33 disposed along the circumferential edge of the top plate portion 32 and extending on the rear side of the top plate portion so as to be formed into a cap shape. The side plate portion 33 may extend from the top plate portion 32 so as to be substantially perpendicular thereto (see FIG. 3A) or may extend from the top plate portion 32 so as to be tilted outward (see FIG. 3B). Flange portions 34 are provided at four protruding corners of the side plate portion 33 so as to extend outward. Through holes 34*a* are formed in the flange portions 34. Bolts 35 are inserted into the through holes 34*a* and screwed into holes 3*c* provided in the head portion of the cylinder block 3, and the valve-operating chamber cover 31 is thereby fixed to the cylinder block 3. As shown in FIGS. 4A, 4B, and 4C, an annular recessed groove 33*a* along an opening end 31*a* of the valve-operating chamber cover 31 is formed in the inner end surface of the side plate portion 33 of the valve-operating chamber cover 31. A step portion 41 (described later) of the inner cover 40 is fitted into the recessed groove 33*a*, and the inner cover 40 is thereby fixed.

A breather passage 36 is provided at substantially the center of the top plate portion 32 of the valve-operating chamber cover 31. The first end portion of the breather passage 36 extends from the top plate portion 32 to the inside of the valve-operating chamber cover 31. The breather passage 36 is configured such that its opening end 36*a* is located substantially at the center of the valve-operating chamber 30 when the valve-operating chamber cover 31 is fixed to the cylinder block 3 (see FIGS. 1, 4A, and 4B). The second end portion of the breather passage 36 extends along the surface of the top plate portion 32 and protrudes outward from the side plate portion 33.

As shown in FIGS. 3A and 3B, the inner cover 40 has a shape smaller than but geometrically similar to the shape of the valve-operating chamber cover 31. The inner cover 40 includes a rectangular top plate portion 42 and a side plate portion 43 disposed along the circumferential edge of the top plate portion 42 and extending on the rear side of the top plate portion so as to be formed in a cap shape. The inner cover 40 is disposed on the inner side of the valve-operating chamber cover 31. The top plate portion 42 of the inner cover 40 faces the top plate portion 32 of the valve-operating chamber cover 31 and is in contact therewith, and the side plate portion 43 of the inner cover 40 faces the side plate portion 33 of the valve-operating chamber cover 31 and is in contact therewith. The inner cover 40 is thereby attached inside the valve-operating chamber cover 31. More specifically, the inner cover 40 is attached inside the valve-operating chamber cover 31 with the outer surface of the inner cover 40 disposed along and in contact with the inner surface of the valve-operating chamber cover 31.

The side plate portion 43 of the inner cover 40 extends along the side plate portion 33 of the valve-operating chamber cover 31. Therefore, when the side plate portion 33 of the valve-operating chamber cover 31 extends substantially perpendicular to the top plate portion 32 of the valve-operating chamber cover 31, the side plate portion 43 of the inner cover 40 also extends substantially perpendicular to the top plate portion 42 of the inner cover 40. When the side plate portion 33 of the valve-operating chamber cover 31 extends from the top plate portion 32 of the valve-operating chamber cover 31 so as to be tilted outward, the side plate portion 43 of the inner cover 40 also extends from the top plate portion 42 of the inner cover 40 so as to be tilted outward.

A through hole 42*a* for allowing the breather passage 36 to be inserted thereinto is provided at substantially the center of the top plate portion 42 of the inner cover 40. The annular step portion 41 protruding outward from the circumferential edge of the opening end of the inner cover 40 is provided at the protruding end of the side plate portion 43 of the inner cover 40. When the valve-operating chamber cover 31 is fixed to the cylinder block 3 through the bolts 35 with the step portion 41 fitted into the recessed groove 33*a* of the valve-operating chamber cover 31, the inner cover 40, together with the valve-operating chamber cover 31, is fixed to the cylinder block 3 through the step portion 41.

As shown in FIGS. 4A, 4B, and 4C, a flat annular shoulder portion 44 that connects the end portions of the top plate portion 42 and the side plate portion 43 of the inner cover 40 is provided between the top plate portion 42 and the side plate portion 43 so as to extend along the edge of the top plate portion 42. The shoulder portion 44 is configured such that an annular gap is formed between the outer surface of the shoulder portion 44 and the inner surface of the valve-operating chamber cover 31 when the inner cover 40 is attached inside the valve-operating chamber cover 31. This gap serves as a suction passage 45 that communicates with suction tubes 46 described later.

Three suction tubes 46 extending toward the opening edge of the inner cover 40 are provided in the inner cover 40. These suction tubes 46 protrude outward from an opening edge 40*a* of the inner cover 40, and opening ends 46*b* are formed at the protruding ends of the suction tubes 46. The base portions of the suction tubes 46 pass through the side plate portion 43 to form opening ends 46*a* (see FIG. 3B). The opening ends 46*a* communicate with the suction passage 45 when the inner cover 40 is attached inside the valve-operating chamber cover 31. The opening ends 46*b* on the protruding side of the suction tubes 46 are disposed near an end face 30*a* (see FIG. 3A) of the valve-operating chamber 30 that faces the top plate portion 32 so that oil on the end face 30*a* is sucked.

Figure 5A:
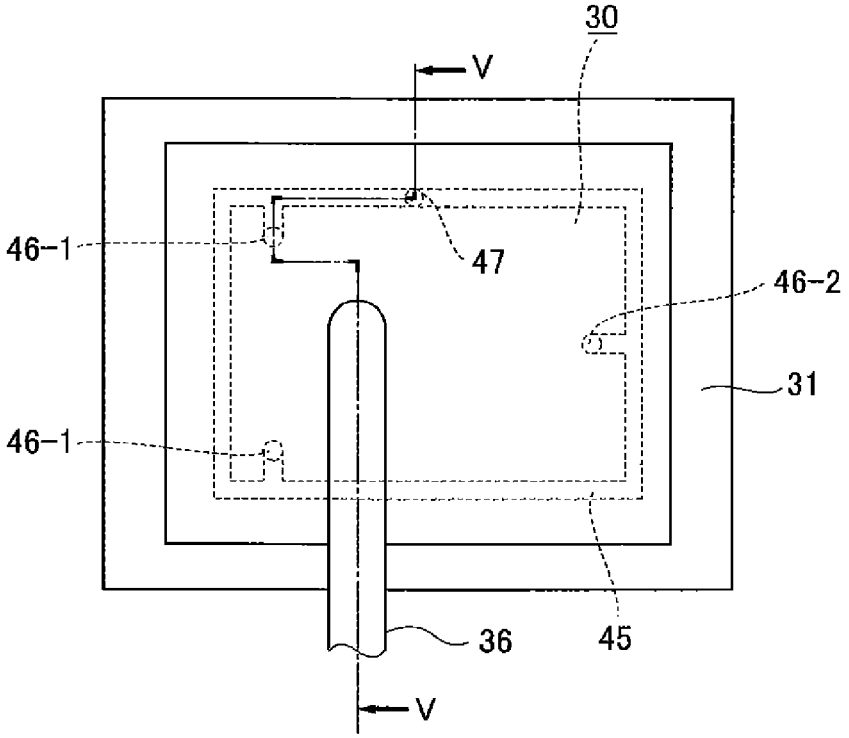
FIG. 5A is a plan view of the valve-operating chamber of the portable four-stroke engine equipped with the lubrication system according to the present invention.
Figure 5B:
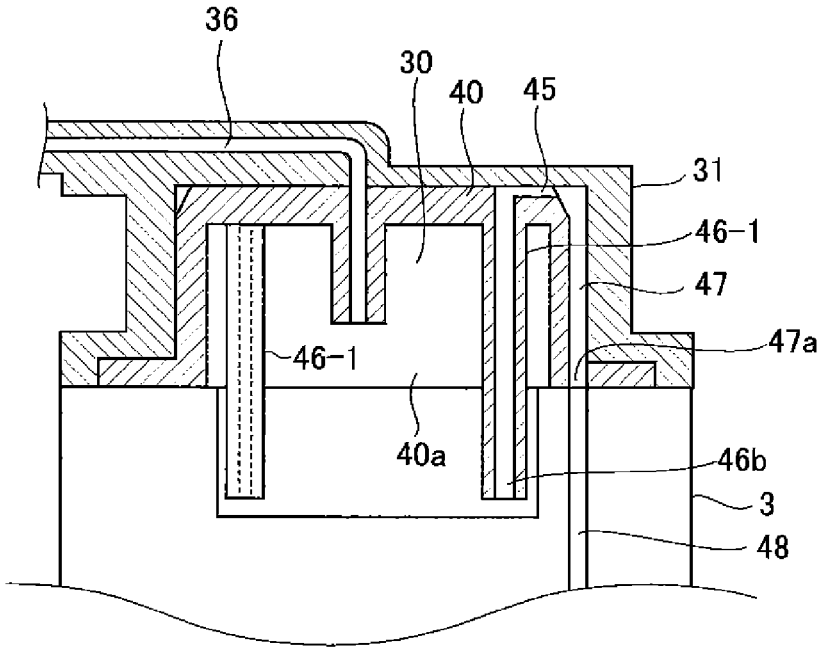
FIG. 5B is a cross-partial view of a section taken along lines indicated by arrows V in FIG. 5A.

With reference to FIGS. 2 and 5A, two suction tubes 46-1 of the three suction tubes 46 are disposed in the valve-operating chamber 30 and located at positions near opposite widthwise ends of a first side of the valve-operating chamber 30 near a working unit 71 which receives power from a crankshaft 9 during operation. The remaining suction tube 46-2 is disposed in the valve-operating chamber 30 and located near the widthwise midpoint of a second side opposite to the working unit side.

When the inner cover 40 is attached to the valve-operating chamber cover 31, a space is formed between the inner cover 40 and the side plate portion 33 of the valve-operating chamber cover 31 so as to serve as a cover-side direct passage 47. In the attached state, the cover-side direct passage 47 is in communication with the suction passage 45. An opening end 47*a* of the direct passage 47 is substantially flush with the opening edge 40*a* of the inner cover 40 (see FIG. 4B). The cover-side direct passage 47 is disposed so as to communicate with a block-side direct passage 48 that is provided in the cylinder block 3 and in communication with the crank chamber 5*a* when the valve-operating chamber cover 31 is fixed to the cylinder block 3 with the inner cover 40 attached inside the valve-operating chamber cover 31. Therefore, the suction tubes 46 communicate with the crank chamber 5*a* through the suction passage 45, the cover-side direct passage 47, and the block-side direct passage 48. The inner cover 40 is integrally molded using a material such as a synthetic resin.

In this configuration, the suction passage 45 in communication with the suction tubes 46 can be easily formed by simply attaching the inner cover 40 inside the valve-operating chamber cover 31.

As shown in FIG. 1, the block-side direct passage 48 communicates with the crank chamber 5*a*. As in the opening end 54*a* of the oil feed passage 54, an opening end 48*a* of the block-side direct passage 48 being opened in the crank chamber 5*a* is disposed so as to establish communication with the crank chamber 5*a* when the piston 13 moves from a position near the top dead center toward the top dead center. This opening end 48*a* is positioned on the bottom dead center side of the skirt 13*a* provided in the lower portion of the piston when the piston is moved to the position near the top dead center. Therefore, the opening end 48*a* of the direct passage 48 is already in a fully open state when the piston 13 reaches the top dead center.

A one-way valve that allows a flow from the valve-operating chamber 30 toward the crank chamber 5*a* but prevents a flow from the crank chamber 5*a* toward the valve-operating chamber 30 may be provided in the block-side direct passage 48. In this manner, the back flow of oil and oil mist from the crank chamber 5*a* to the valve-operating chamber 30 can be reliably prevented.

The second end of the breather passage 36 is connected to an air cleaner 63. The breather passage 36 is provided to discharge blow-by gas into a combustion chamber. The oil mist and blow-by gas in the valve-operating chamber 30 are delivered to the air cleaner 63 through the breather passage 36, and oil and the blow-by gas are separated by an oil separator 63*a* provided in the air cleaner 63. As described above, the breather passage 36 at its first end is opened at substantially the center of the valve-operating chamber 30. Therefore, even when a large amount of oil stays in the valve-operating chamber 30, the oil is not easily sucked. A one-way valve 36*b* is provided in the breather passage 36, and the backflow of blow-by gas and oil mist from the air cleaner 63 toward the valve-operating chamber 30 is prevented by the one-way valve 36*b*.

The liquid oil separated from the gas component is delivered to the crank chamber 5*a* through a circulation passage 65 that communicates the air cleaner 63 with the crank chamber 5*a*. A one-way valve 65*a* that allows only a flow toward the crank chamber is disposed in the circulation passage 65. The blow-by gas separated from the liquid component is delivered to the combustion chamber together with intake air.

A return passage 66 for returning the oil in the valve driving chamber 52 to the crank chamber 5*a* is provided between the crank chamber 5*a* and the bottom portion of the valve driving chamber 52 on the oil reservoir side. When a negative pressure is created in the crank chamber 5*a*, the oil accumulated in the valve driving chamber 52 is sucked through the return passage 66. The return passage 66 is formed to have a cross-sectional area smaller than 1/10 of the cross-sectional area of the communication passage 59. When a positive pressure is created in the crank chamber 5*a*, the reed valve 60 is opened, and the crank chamber 5*a* and the oil reservoir 7 are thereby in communication with each other. The oil mist and oil in the crank chamber 5*a* flow through the communication passage 59 having a large cross-sectional area, and the return passage 66 is blocked with oil. Therefore, almost no oil flows back from the crank chamber 5*a* to the valve driving chamber 52. In the present embodiment, the inner diameter of the communication passage 59 is set to $\phi 9$ mm, and the inner diameter of the return passage 66 is set to $\phi 2$ mm.

The return passage 66 may be provided such that the valve driving chamber 52 and the block-side direct passage 48 are in communication with each other. By providing the return passage 66 in the manner described above, oil is not supplied more than necessary to the valve-operating chamber 30. A one-way valve that allows a flow toward the crank chamber but prevents a flow toward the valve driving chamber 52 may be provided in the return passage 66. In this manner, the backflow of oil from the crank chamber 5*a* to the valve driving chamber 52 can be reliably prevented.

A flow rate control passage 67 is provided between the valve driving chamber 52 and the oil feed passage 54. The air in the valve driving chamber 52 is sucked into the flow rate control passage 67, and the flow rate of oil supplied to the crank chamber 5*a* through the oil feed passage 54 is thereby controlled. When the amount of sucked air is large, the flow rate of oil supplied through the oil feed passage 54 is low. Preferably, the flow rate control passage 67 is disposed so as to be spaced apart from the bottom of the valve driving chamber 52 so that the oil staying in the valve driving chamber 52 is less likely to be sucked.

The flow rate control passage 67 is connected to the oil feed passage 54 at a position that is closer to the oil reservoir than the one-way valve 57 provided in the oil feed passage 54. Therefore, when the supply of oil is stopped by the one-way valve 57, the oil in the oil feed passage 54 is accumulated on the oil reservoir side of the one-way valve 57, and the oil is accumulated in the connection portion of the flow rate control passage 67 to the oil feed passage 54. Therefore, when air is sucked from the flow rate control passage 67 into the oil feed passage 54, only the air does not flow through the oil feed passage 54, but the oil in the oil feed passage 54 is delivered to the crank chamber 5*a* together with the air delivered from the valve driving chamber 52.

A flow restrictor 68 for controlling the flow rate of air delivered from the valve driving chamber 52 to the oil feed passage 54 is provided in the flow rate control passage 67. By controlling the flow restrictor 68 to adjust the amount of air sucked from the valve driving chamber 52, the flow rate of oil supplied to the crank chamber 5*a* through the oil feed passage 54 can be controlled. More specifically, the flow rate of oil can be easily controlled only by the design of the flow restrictor 68, irrespective of the inner diameter of the flow rate control passage 67.

The flow restrictor 68 may not be provided separately from the flow rate control passage 67 and may be provided as a part of the flow rate control passage 67. For example, if a part of the flow rate control passage 67 is formed along the sealing surface between the cylinder block 3 and the crank case 5 and is connected to the oil feed passage 54 at a position on the sealing surface, the flow restrictor 68 can be easily formed.

More specifically, the circulation path of the lubrication system 70 includes the oil feed passage 54, the communication passage 59, the supply passage 51, the suction tubes 46, the suction passage 45, the cover-side direct passage 47, the block-side direct passage 48, the breather passage 36, the circulation passage 65, the return passage 66, and the flow rate control passage 67.

When the engine 1 is started, pressure changes occur in the crank chamber 5*a* due to the upward and downward movement of the piston 13. When the piston 13 moves upward, the pressure inside the crank chamber 5*a* is reduced, so that a negative pressure tends to be created. When the piston 13 moves downward, the pressure inside the crank chamber 5*a* is increased, so that a positive pressure tends to be created.

As the piston 13 moves to the vicinity of the top dead center, a negative pressure tends to be created in the crank chamber 5*a*, and communication between the opening end 54*a* of the oil feed passage 54 and the crank chamber 5*a* is established. Then the crank chamber 5*a* communicates with the oil reservoir 7, and the negative pressure created in the crank chamber 5*a* is applied to the oil feed passage 54. Even when the engine 1 is tilted, the suction part 55 of the oil feed passage 54 is located below the surface of the oil A in the oil reservoir 7, and the oil A is sucked from the oil reservoir 7 and delivered to the crank chamber 5*a*. Since the opening end 54*a* is already in a fully open state when the piston 13 reaches the top dead center, the negative pressure in the crank chamber 5*a* can be sufficiently applied to the oil feed passage 54. Therefore, the oil A sucked from a position below the oil surface can be sufficiently supplied to the crank chamber 5*a*.

The oil delivered to the crank chamber 5*a* lubricates the driving components such as the piston 13 and the connecting rod 11 and is simultaneously scattered by the driving components to form oil mist. Part of the oil mist adheres to the wall surfaces of the crank chamber 5*a* and is re-liquefied.

When the piston 13 moves downward from the top dead center, a positive pressure is created in the crank chamber 5*a*, and the reed valve 60 is opened to communicate the crank chamber 5*a* with the oil reservoir 7. Then, the oil mist and oil increased in pressure in the crank chamber 5*a* are delivered to the oil reservoir 7 through the communication passage 59, and the pressure inside the oil reservoir 7 is increased. The oil mist ejected from the communication passage 59 collides with the surface of the oil A stored in the oil reservoir 7 and with the wall surfaces of the oil reservoir 7, is thereby liquefied, and is stored in the oil reservoir 7. The concentration of the remaining oil mist that has collided and bounced off within the oil reservoir 7 is lower than the concentration of oil mist in the crank chamber 5*a*. When a positive pressure is created in the crank chamber 5*a*, the oil feed passage 54 is blocked by the action of the one-way valve 57 so that oil is prevented from flowing back from the crank chamber 5*a* to the oil reservoir 7, and then the opening end 54*a* is covered with the piston 13.

When the pressure inside the oil reservoir 7 is increased, a pressure gradient is generated between the oil reservoir 7 and the valve-operating chamber 30. The oil mist accumulated in the oil reservoir 7 is delivered to the valve-operating chamber 30 through the supply passage 51. In the process of delivering the oil mist from the oil reservoir 7 to the valve-operating chamber 30, the components included in the valve-operating mechanism 19 in the valve driving chamber 52 provided in the supply passage 51 are lubricated. During this process, part of the oil mist is liquefied.

The oil liquefied in the valve driving chamber 52 can be delivered to the crank chamber 5*a* through the return passage 66. Therefore, excessive accumulation of oil in the valve driving chamber 52 can be prevented, and the flow of oil to the valve-operating chamber 30 can thereby be prevented. In addition, clogging of the supply passage 51 with oil can be prevented.

The oil mist supplied to the valve-operating chamber 30 lubricates the valve mechanism 24 provided in the valve-operating chamber 30 and is delivered to the crank chamber 5*a* through the cover-side direct passage 47 and the block-side direct passage 48. Even when the oil mist supplied to the valve-operating chamber 30 is liquefied and stays therein, a strong negative pressure in the crank chamber 5*a* is applied to the liquefied oil, and therefore the oil can be delivered to the crank chamber 5*a*, so that the oil is prevented from staying in the valve-operating chamber 30.

Therefore, the oil is prevented from being emitted together with blow-by gas discharged from the valve-operating chamber 30 through the breather passage 36.

Figure 6:
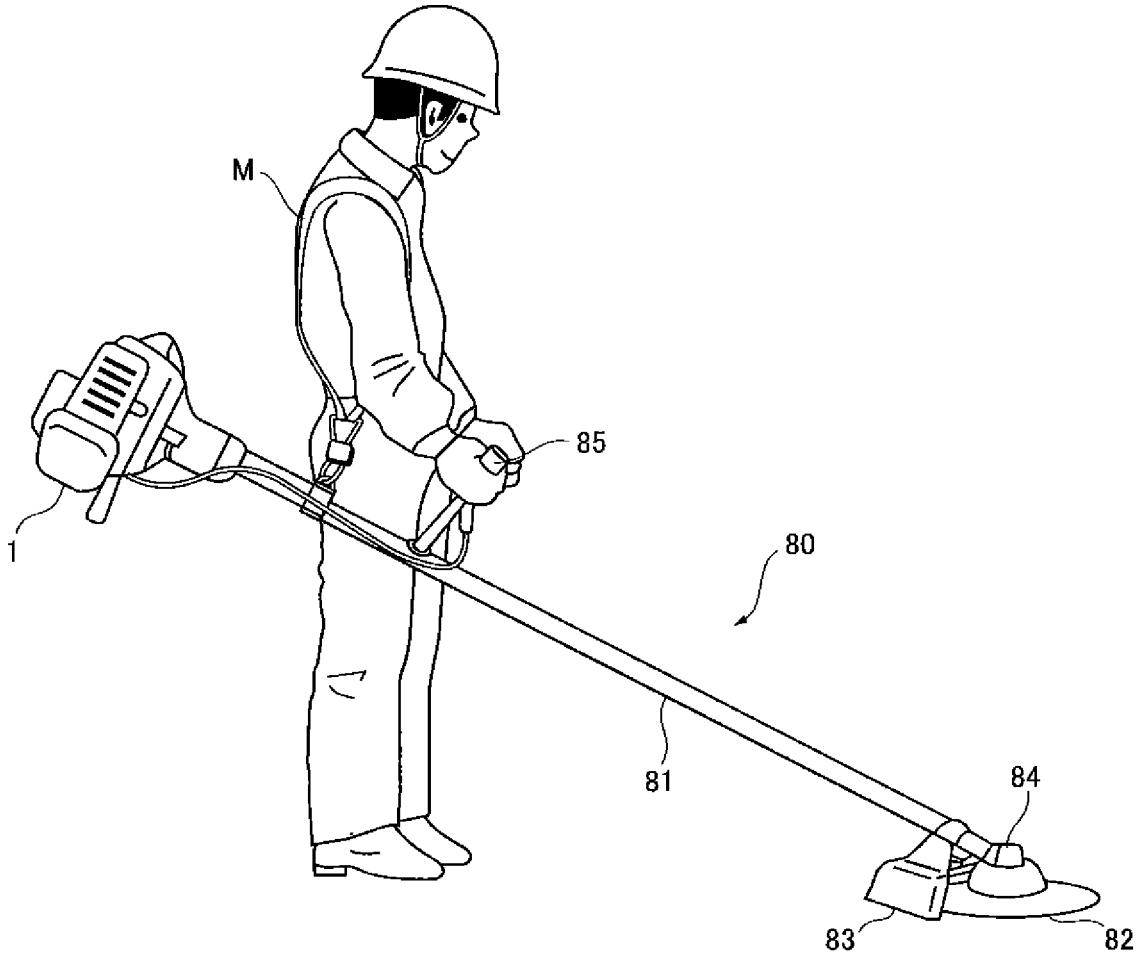
FIG. 6 is a side view illustrating a trimmer equipped with the portable four-stroke engine according to the present invention.

When the engine 1 equipped with the lubrication system 70 configured as above is installed in a trimmer, which is an exemplary power tool, the above-described lubrication effect of the engine 1 can be efficiently obtained. As shown in FIG. 6 (side view), the trimmer 80 equipped with the engine 1 includes: the engine 1 attached to the rear end of an operating rod 81; a disk-shaped trimming edge 82 rotatably attached to the front end of the operating rod 81; and a safety cover 83 attached to the front end of the operating rod 81 so as to cover the trimming edge 82.

A gear head 84 is attached to the front end of the operating rod 81 and connected to the driving shaft (not shown) of the engine 1 through a driving shaft (not shown) provided in the operating rod 81, so that the power of the engine 1 can be transmitted to the gear head 84. The trimming edge 82 is attached to the gear head 84, and the power of the engine 1 is transmitted to the trimming edge 82 through the gear head 84 to rotate the trimming edge 82.

A handle 85 is attached to an intermediate portion of the operating rod 81, and a control lever (not shown) for controlling the power of the engine 1 is attached to the handle 85. An operator M operates the handle 85 with hands to perform trimming.

Figure 7A:
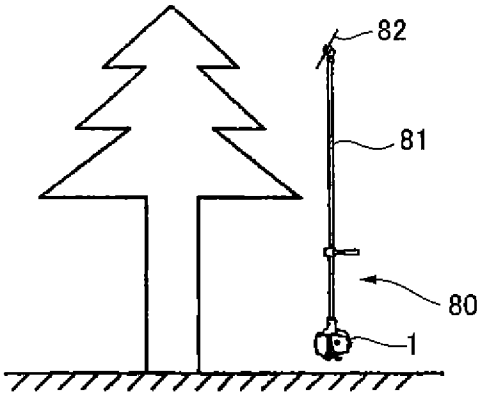
FIGS. 7A to 7K are side views illustrating possible operating attitudes of the trimmer.
Figure 7B:
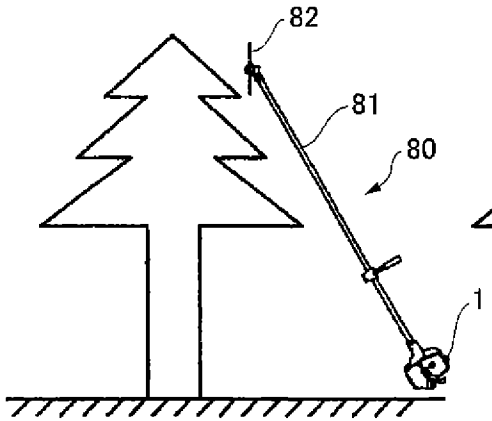
Figure 7C:
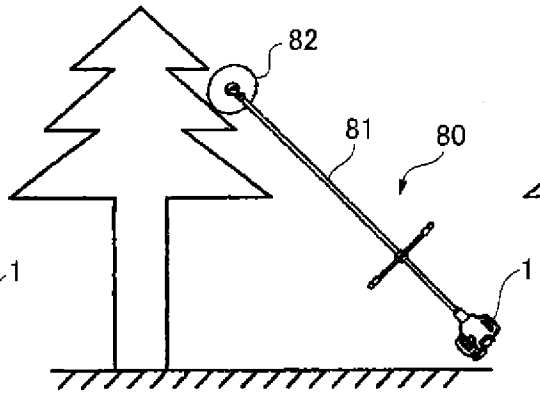
Figure 7D:
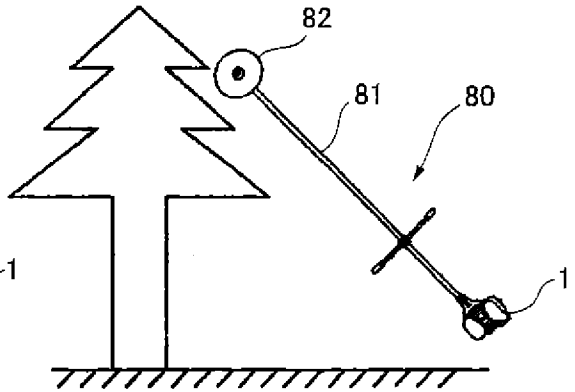
Figure 7E:
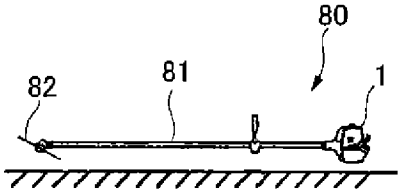
Figure 7F:
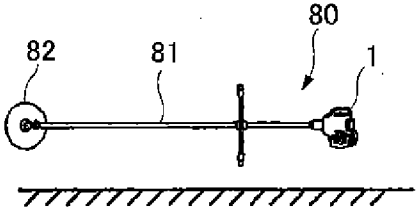
Figure 7G:
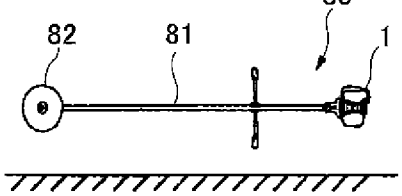
Figure 7H:
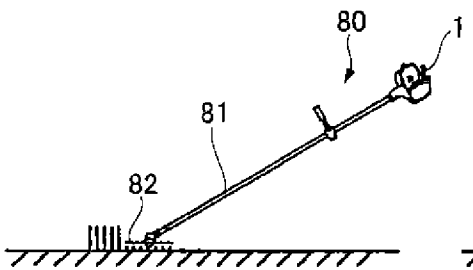
Figure 7I:
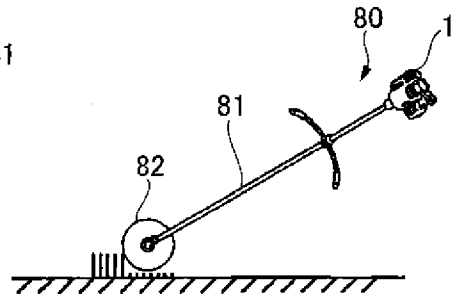
Figure 7J:
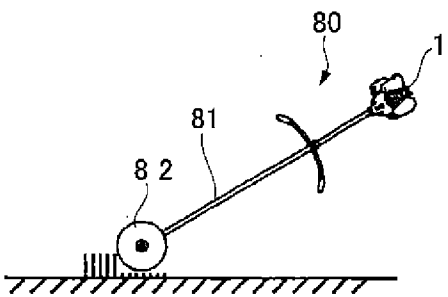
Figure 7K:
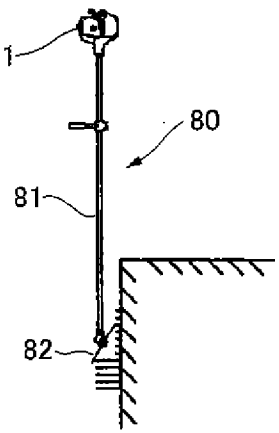

FIGS. 7A to 7K are side views for illustrating the possible operating attitudes of the trimmer 80 equipped with the engine 1. FIGS. 9A to 9K are cross-partial views for illustrating the levels of lubricating oil staying in the valve-operating chamber 30, these levels corresponding to the operating attitudes of the trimmer 80 shown in FIGS. 7A to 7K, respectively. The operating attitude of the trimmer 80 shown in FIG. 7H is a normal operating attitude.

In all the possible operating attitudes of the trimmer 80 shown in FIGS. 7A to 7K, at least one of the opening ends of the three suction tubes 46 is always located lower than the opening end 36*a* of the breather passage 36 that is opened in the valve-operating chamber 30, as shown in FIGS. 9A to 9K. Even when a large amount of the lubricating oil A is accumulated in the valve-operating chamber 30, the accumulated lubricating oil A is discharged to the oil reservoir 7 shown in FIG. 1 before the accumulated lubricating oil A covers the opening end 36*a* of the breather passage 36, so that excessive accumulation of the lubricating oil in the valve-operating chamber 30 can be prevented.

Figure 8A:
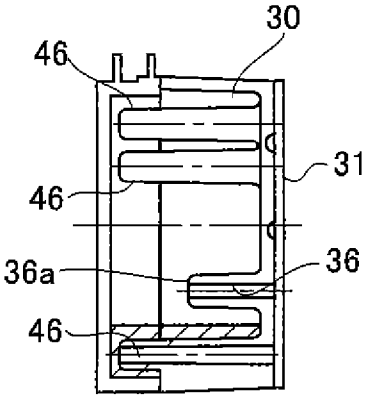
FIGS. 8A to 8K are cross-partial views of the valve-operating chamber, illustrating the levels of lubricating oil staying in the valve-operating chamber, each of these levels corresponding to one of the possible operating attitudes of the trimmer.
Figure 8B:
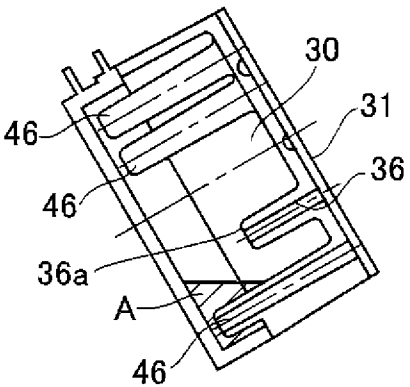
Figure 8C:
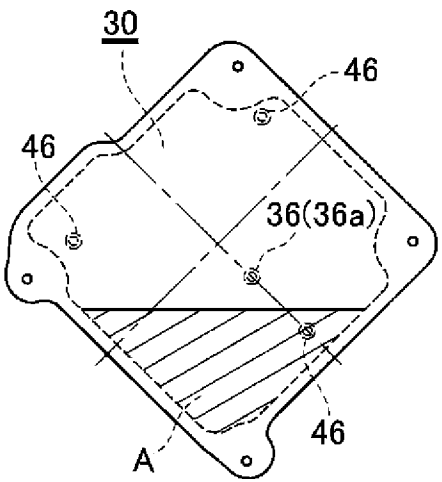
Figure 8D:
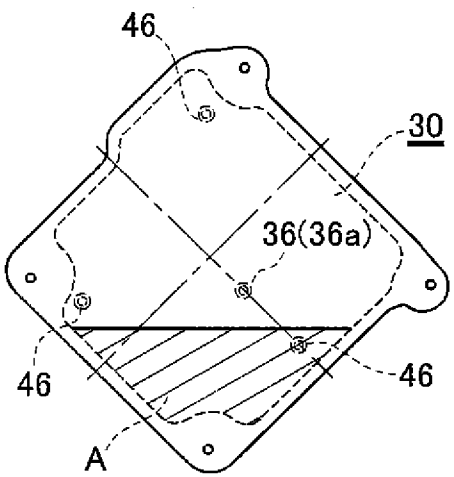
Figure 8E:
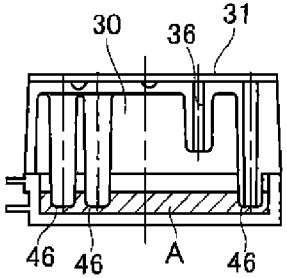
Figure 8F:
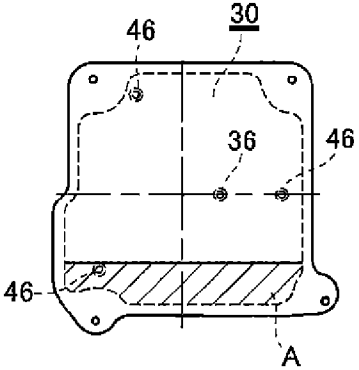
Figure 8G:
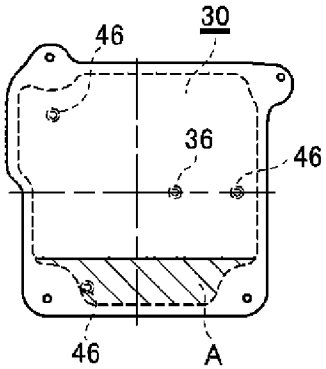
Figure 8H:
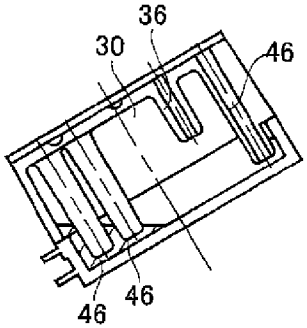
Figure 8I:
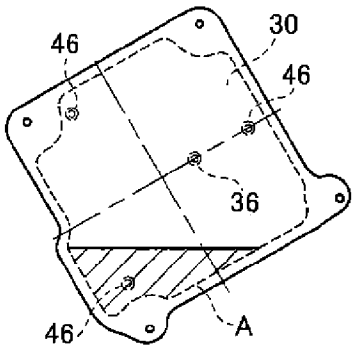
Figure 8J:
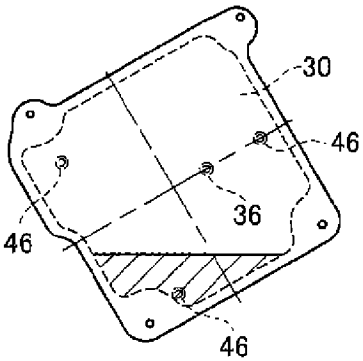
Figure 8K:
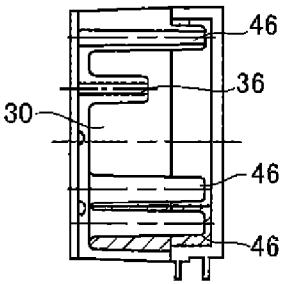

In particular, in the operating attitudes shown in FIGS. 7C and 7D, the possible distance between the surface of the accumulated lubricating oil A and the opening end 36*a* of the breather passage 36 is shortest, as shown in FIGS. 8C and 8D. However, the opening end 36*a* is not easily covered with the accumulated lubricating oil A. Therefore, the liquefied lubricating oil A is not discharged from the opening end 36*a*.

As described above, even when the above-described engine 1 is installed in the trimmer 80 that greatly changes its attitude, excessive accumulation of the lubricating oil in the valve-operating chamber 30 does not occur in all the possible operating attitudes, and therefore the liquefied lubricating oil is not discharged from the opening end 36*a*.

Figure 9:
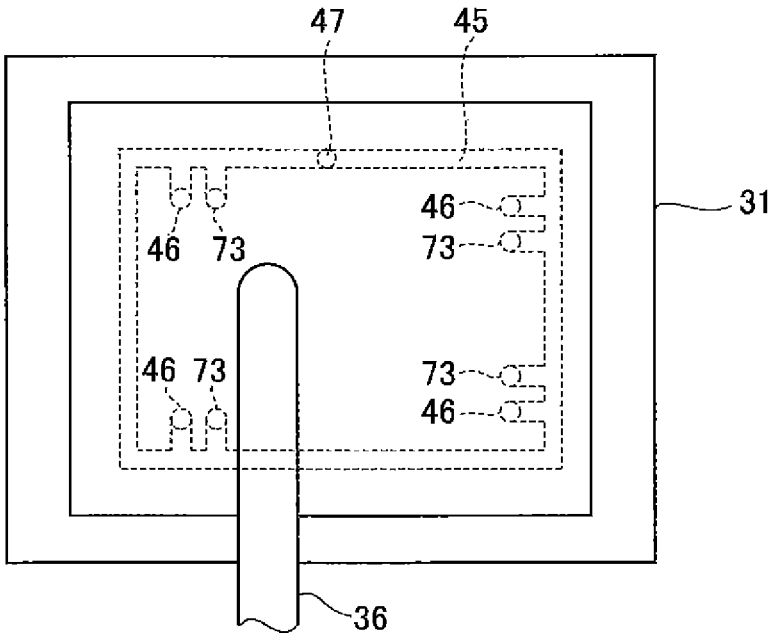
FIG. 9 is a schematic plan view illustrating the valve-operating chamber of a portable four-stroke engine according to another embodiment of the present invention.

In the embodiment described above, two suction tubes 46 are provided in the valve-operating chamber 30 near the working unit, and one suction tube 46 is provided in the valve-operating chamber 30 on its side opposite to the working unit. However, as shown in FIG. 9, four suction tubes 46 may be provided in the valve-operating chamber 30 (two being located at positions near opposite widthwise ends of a first side of the valve operating chamber 30 and two being located at positions near opposite widthwise ends of a second side opposite to the working unit side), and small holes 73 in communication with the suction passage 45 may be provided near the suction tubes 46. These small holes 73 are formed around the base portions of the suction tubes 46. With this configuration, even when the engine 1 is tilted and held upside down such that the valve-operating chamber 30 is located at a lower position, the oil accumulated in the valve-operating chamber 30 can be sucked through at least one of the small holes 73. Therefore, the oil in the valve-operating chamber 30 can be sucked and collected into the crank chamber 5*a* regardless of the attitude of the power tool.

Figure 10A:
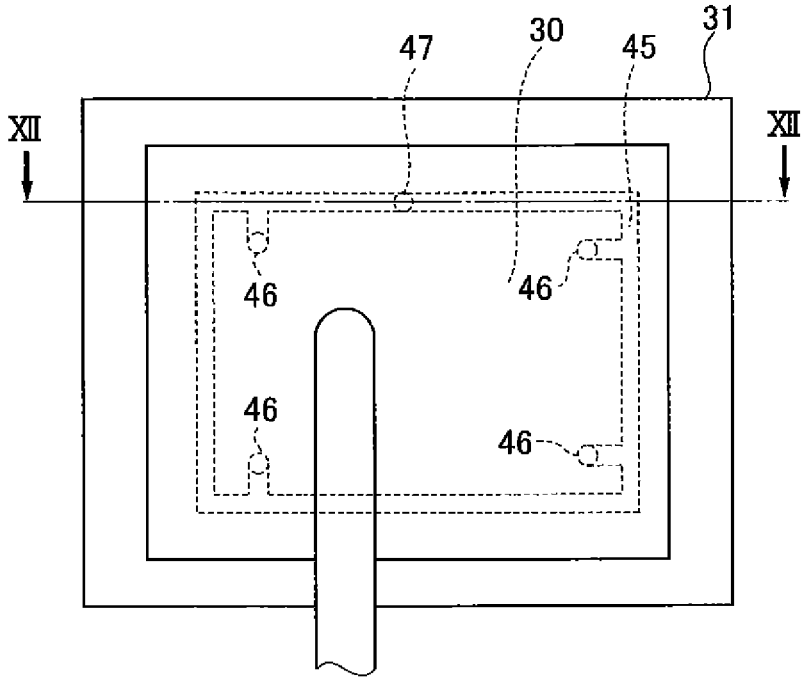
FIG. 10A is a plan view illustrating the valve-operating chamber of a portable four-stroke engine equipped with a lubrication system according to another embodiment of the present invention.
Figure 10B:
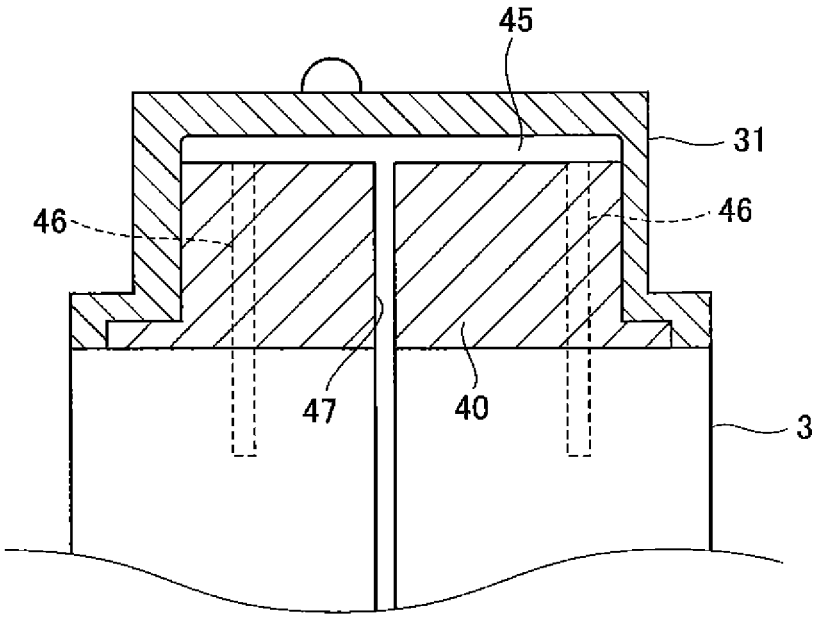
FIG. 10B is a cross-partial view of a section taken along a line indicated by arrows XII in FIG. 10A.

If the work is not performed in the upside-down state in which the valve-operating chamber 30 is located at a lower position, the small holes 73 may be omitted, and four suction tubes 46 may be provided in the valve-operating chamber 30 in the manner shown in FIGS. 10A and 10B (i.e., two being located at positions near opposite widthwise ends of a first side of the valve operating chamber 30 and two being located at positions near opposite widthwise ends of a second side opposite to the working unit side).

The invention claimed is:

1. A lubrication system for a portable four-stroke engine configured to lubricate components in a valve-operating chamber and in a crank chamber with oil by supplying the oil by utilizing changes in pressure inside the crank chamber caused by reciprocating movement of a piston while circulating the oil, the valve-operating chamber accommodating intake and exhaust valve mechanisms therein, and configured to discharge blow-by gas in an oil circulation path from the valve-operating chamber to a combustion chamber through a breather passage connected to the valve-operating chamber, comprising:

an opening end of the breather passage on a side of the valve-operating chamber that is disposed at substantially a center of the valve-operating chamber, wherein the valve-operating chamber is formed by attaching a valve-operating chamber cover, and the valve-operating chamber cover has a top plate portion and a side plate portion disposed along a circumferential edge of the top plate portion so as to be formed in a cap shape;

an inner cover that is attached to an inner surface of the valve-operating chamber cover so as to be provided along and in contact with the inner surface of the valve-operating chamber cover;

a suction passage that is formed as a gap between the circumferential edge of the top plate portion and the inner cover, the gap being formed by attaching the inner cover to the valve-operating chamber cover;

three or more suction tubes that are in communication with the suction passage and provided in the inner cover, each of the suction tubes extending to the vicinity of an end surface of the valve-operating chamber which faces the top plate portion, each of the suction tubes having an opening end that is disposed in the vicinity of the end surface; and a direct passage by which the suction passage communicates with the crank chamber when a negative pressure is created in the crank chamber, wherein at least one of the opening ends of the three or more suction tubes is provided lower than the opening end of the breather passage in an aspect of use of the four-stroke engine the lubrication system is configured to generate oil mist inside the crank chamber and to deliver the oil mist to the valve-operating chamber;

an oil reservoir, wherein at least a portion of the oil mist generated in the crank chamber is transferred to the oil reservoir and is directed into the oil reservoir by a communication passage having an opening that faces a surface of liquid oil in the oil reservoir, and a supply passage having a supply opening in the oil reservoir and connecting the oil reservoir to the valve-operating chamber, wherein the opening of the communication passage in the oil reservoir is disposed lower than the supply opening of the supply passage in the oil reservoir so as to protrude farther into the oil reservoir.

* * * * *